United States Patent [19]

Grimes et al.

[11] Patent Number: 4,653,236

[45] **Date of Patent: * Mar. 31, 1987**

[54] COATED ABRASIVE DISC

[76] Inventors: Philip M. Grimes, 15 McMurrich Street, Toronto, Ontario, Canada, M5R 3M6; John R. Grimes, 33 Harbour Square, Toronto, Ontario, Canada, M5J 2G2

[ * ] Notice: The portion of the term of this patent subsequent to Nov. 26, 2002 has been disclaimed.

[21] Appl. No.: 797,672

[22] Filed: Nov. 13, 1985

Related U.S. Application Data

[63] Continuation-in-part of Ser. No. 588,580, Mar. 12, 1984, Pat. No. 4,554,765, which is a continuation-in-part of Ser. No. 471,698, Mar. 3, 1983, Pat. No. 4,525,177.

[51] Int. Cl.[4] ..... B24D 11/00

[52] U.S. Cl. ..... 51/401; 51/358; 51/297; 51/298

[58] Field of Search ..... 51/295, 297, 298, 358, 51/376, 377, 378, 379, 394–407

[56] References Cited

U.S. PATENT DOCUMENTS

| | | | |
|---|---|---|---|
| 2,842,844 | 7/1958 | Seal | 51/397 X |
| 3,082,582 | 3/1963 | Jeske . | |
| 3,196,586 | 7/1965 | Brown et al. | 51/394 |
| 3,284,178 | 11/1966 | Timmer et al. | 51/297 |
| 3,306,718 | 2/1967 | Chapin | 51/297 |
| 3,364,630 | 1/1968 | Rusk et al. | 51/358 |
| 4,088,729 | 5/1978 | Sherman | 51/298 X |
| 4,554,765 | 11/1985 | Grimes et al. | 51/401 |

FOREIGN PATENT DOCUMENTS

| | | | |
|---|---|---|---|
| 727595 | 4/1955 | United Kingdom | 51/401 |
| 1357483 | 6/1974 | United Kingdom . | |

*Primary Examiner*—Robert P. Olszewski
*Attorney, Agent, or Firm*—Fetherstonhaugh & Co.

[57] ABSTRACT

The invention is a coated abrasive grinding disc for mounting in the chuck of a drill or the like wherein the grinding pad is of a thermoplastic material having a layer of abrasive material bonded thereto with a layer of thermosetting plastics material.

9 Claims, 6 Drawing Figures

COATED ABRASIVE DISC

This invention relates to a self-supporting grinding disk for mounting on the shaft of a power tool for rotation, and is a continuation-in-part application to application Ser. No. 06/588,580 filed Mar. 12, 1984 now U.S. Pat. No. 4,544,765 which is in turn a continuation-in-part application to application Ser. No. 06/471,698 now U.S. Pat. No. 4,525,177 filed Mar. 3, 1983. More particularly, the invention relates to a self-supporting grinding disk for mounting on the shaft of a power tool that has an abrasive grinding face for parallel grinding and a peripheral edge for edge grinding.

RELATED ART

Grinding disks are used extensively in industry in the finished sanding of metal, wood and plastics manufactured parts that require finishing by smoothing after welding, moulding or other manufacturing processes.

The abrasives industry supplies enormous quantities of grinding disks for this purpose. Prior to this invention, however, the commonly used disks have not been self-supporting. The common disks of the prior art comprise a backing of sheet material such as paper, cloth, fibre or the like to which is applied a coating of an abrasive grit material. These coated disks are either mechanically or adhesively secured to a back-up pad which is, in turn, mounted on the shaft of a power tool for rotation. The disks are readily replaceable in use.

Apart from the means for detachably mounting the coated abrasive disks on their back-up pads to make a grinding assembly, there has been no change in the design of the commonly used grinding assembly for as long as most of the present users of the device can remember. The general construction of the grinding assembly commonly used in the industry prior to this invention has always been of this nature.

There are limitations to this utility of the prior art grinding assembly. It cannot, for example, be used effectively for a grinding operation substantially at right-angles to the general plane of the grinding face of the coated disk. This is called edge grinding in this specification.

If edge grinding is attempted to any extent with the disk assemblies of the prior art, the disk wears at its edge and ruptures to expose the back-up pad with the result that the back-up pad ruptures and tears.

These disk assemblies are commonly used in parallel grinding, i.e. where the plane of the disk is substantially parallel to the workpiece. In a parallel grinding operation, the most extensive wear on the disk is at the outer marginal edge portion. When this portion becomes unduly worn, it is often necessary to replace the disk even though there are portions inwardly of the marginal portion where the grinding surface is in better condition.

SUMMARY OF INVENTION

With the present invention, it is possible to take a disk where the outer marginal edge portion is worn and operate the disk in an edge grinding mode to cause the worn marginal portion of the grinding face of the disk to smoothly and continuously heat disintegrate and remove the worn marginal edge portion of the disk. This presents a less worn portion of abrasive coating at the newly formed marginal edge portion of the disk and increases the life and effectiveness of the disk for parallel grinding.

The disk of the present invention is self-supporting, i.e. strong enough to perform parallel and edge grinding operations and in this respect is made from a disk body of thermal plastics material to which is adhered a layer of thermosetting plastics resin which contains abrasive grit. The significant thing about the invention is that these features can be incorporated into a grinding disk provided that the critical parameters described and claimed herein are observed.

A self-supporting grinding disk for mounting on a shaft of a power tool for rotation, the disk having an abrasive grinding face for parallel grinding and a peripheral edge for edge grinding according to this invention comprises:

- a round disk body of thermoplastics material, said disk body having a central hub portion for securing the disk to a shaft and a flexible workpiece-contour-following portion outwardly of the hub portion;
- a layer of thermosetting plastics resin which contains abrasive grit coated directly on the disk body to comprise the grinding face of said grinding disk, the plastics resin being curable at a temperature of less than 125° C. and cured, the thermosetting plastics resin being compatible with the thermoplastics material of the disk body and being bonded and adhesively fused thereto;
- the thickness of the disk body outwardly of the hub being between five one thousandths and fifty one thousandths of an inch;
- the diameter of the disk body being no more than four inches;
- the disk body having a coefficient of linear thermal expansion between 0.00005 and 0.0001 inch per inch per degree centigrade as tested by the A.S.T.M. testing standard D 696-79;
- the disk body being composed substantially of a polyamide thermoplastic material and having a deflection temperature under flexural load of 264 psi of between 125° F. and 350° F. according to the A.S.T.M. testing standard D648-82;
- said disk body having a melting point to withstand the heat of grinding friction in parallel grinding operations but to be smoothly and continuously heat disintegratable at the same rate as the layer of thermosetting plastics resin which contains the abrasive when the periphery of the grinding disk is used for edge grinding a work piece whereby to present fresh grinding abrasive to the work piece as the diameter of the disk decreases.

The invention will be clearly understood after reference to the following detailed specification read in conjunction with the drawings.

Figure 1:
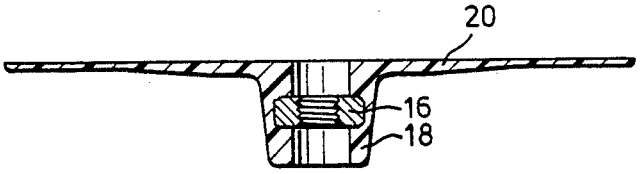
FIG. 1 is a cross-sectional illustration of a disk body of thermal plastics material before the layer of thermosetting plastics resin which contains abrasive grit has been coated thereon to form the composite self-supporting grinding disk.

Referring to the drawings, the numeral 10 generally refers to a finished self-supporting grinding disk according to this invention. It has been broken away to illustrate construction.

In use, the grinding disk is threaded onto the end of shaft 12 of a grinding machine 14. In this connection, a nut 16 is embedded in the hub portion 18 of the disk body 20 so that the shoulder on the shaft 12 is tightened against an end of the nut.

The disk body 20 is made from a thermal plastics material such as nylon and in the embodiment of the invention illustrated has a central hub portion 18 within which is embedded the nut 16 for the purpose of securing the disk to a shaft in use. It also has a flexible workpiece-contour-following portion outwardly of the hub portion. The grinding face is coated with a layer of thermosetting plastics resin 22 which contains abrasive grit. The disk body and the layer of thermosetting grit containing material are fused together to form a self-supporting grinding disk.

Figure 5:
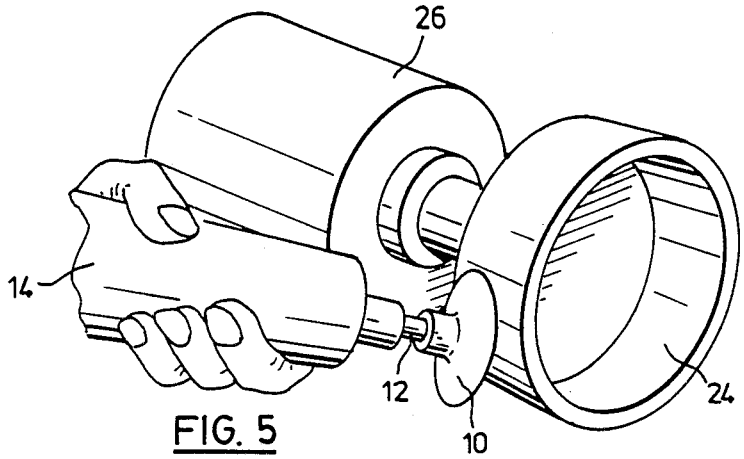
FIG. 5 is an illustation of a parallel grinding operation with the self-supporting grinding disk of the invention.
Figure 6:
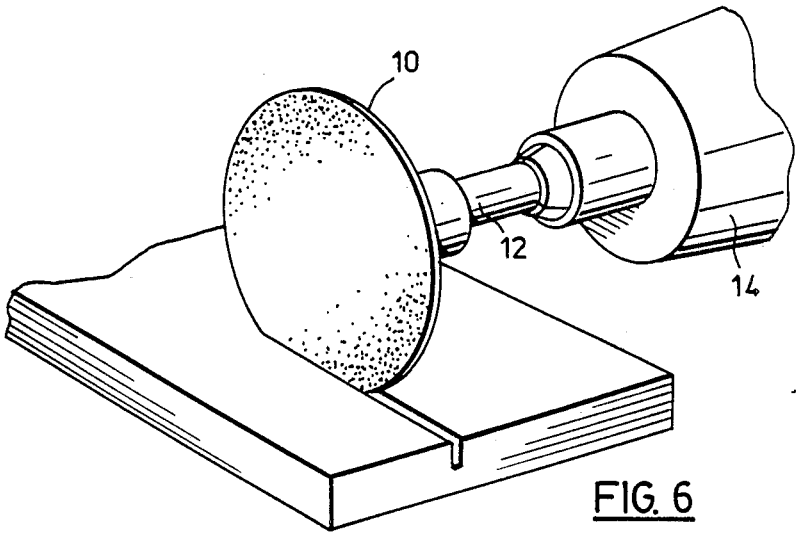
FIG. 6 is an illustration of an edge grinding operation with a self-supporting disk of the invention.

The manner of using the grinding disk is indicated in FIGS. 5 and 6. Firstly, the self-supporting grinding disk is screw threaded to the shaft 12 of a grinding machine 14. The shaft 12 is then mounted into the chuck of the rotational grinding machine which is of conventional design. In the example of FIG. 5, a woodden bowl is mounted in a mandrel that extends from the shaft of an electric motor 26. The wooden bowl is rotated as the motor is operated and the grinding tool 14 is operated to rotate the grinding disk 10 at a rate of about 15000 rpm. The grinding disk is moved over the surface of the bowl to achieve the desired smoothing.

The required mechanical characteristics of the disk body 20 of the self-supporting grinding disk include at least some of the mechanical characteristics of the rubber back-up pad of the prior art that is used to support the removable non-self-supporting coated abrasive disks of the prior art. More specifically, the resilient thermoplastics disk 20 must have resilience, but at the same time it must have strength to transmit the grinding force from the tool 14 as it is urged against the workpiece 24. It must be resilient to flex to the shape of the workpiece, but at the same time, it must have strength to transmit a grinding force when pressed against the workpiece at the temperatures encountered in parallel grinding.

The deflection temperature tests of American Society for Testing and Materials designated as D648-82 are satisfactory for determining deflection of the disk material. The method of these tests covers the determination of the temperature at which an arbitrary deformation occurs when specimens are subjected to an arbitrary set of testing conditions. A test bar of plastics material of rectangular cross section is tested as a simple beam with the load applied at its center to give maximum fiber stresses of 1820 kPa (264 psi). The specimen is immersed under load in a heat-transfer medium provided with a means of raising the temperature. The temperature of the medium is measured when the test bar has deflected 0.25 mm (0.010 in.). This temperature is recorded as the deflection temperature under flexural load of the test specimen. The materials satisfactory for the disk of this invention according to this test have a deflection temperature of between 125° F. and 350° F. for a flexural load of 264 psi on the test bar.

It is not unusual to reinforce plastics materials with fiberglass to increase their strength in deflection. Plastics materials so reinforced are not satisfactory for this invention. They will not disintegrate properly on edge grinding. A plastics disk with any significant amount of fiberglass in it as a reinforcement will have a deflection temperature according to the tests D648-82 of the American Society for Testing and Materials greater than 350° F. and is not within those materials satisfactory for this invention.

The thermal plastics material must also have a relatively high melting point to withstand the heat of the grinding friction encountered in substantially parallel grinding operation such as illustrated in FIG. 5. At the same time, it is part of the function of the disk to disintegrate under the kind of more intense temperatures encountered with an edge grinding operation as illustrated in FIG. 6. These things are discussed in further detail later in the specification.

A further important characteristic of the thermoplastics material of the disk 20 is its ability to become compatible with and fuse to the thermosetting plastic resin 22 that is used to bind the abrasive grit and form the grinding surface of the grinding disk as a unit.

As indicated, the abrasive grit is bonded to the disk body 20. The thermosetting resin is of good thermal and chemical resistance and curable at an appropriate temperature to achieve a hard tough thermal fused state with high strength at elevated temperatures encountered in parallel grinding. The curing characteristics of the resin 22 will be discussed later in this specification.

The abrasive grinding grit may be of any variety of natural or synthetic abrasive material such as diamonds, flint, emery, garnet, aluminum oxide, silicon carbide, alumina, zirconia, ceramic aluminum oxide as required for the job to be done in accordance with standard abrasive practice.

As just noted, the disk body 20 is moulded from a thermo plastics material that is chosen for its compatibility with the thermosetting plastics material 22 and which has the strength and other characteristics necessary to provide a self-supporting grinding disk capable of parallel grinding and also capable of edge grinding to achieve a smooth and continuous heat disintegration at the same rate as the plastic resin grit containing layer 22 is abraded away under conditions of edge grinding. Polyamide of the variety known as type 6 or type 6/6 work well. These types of polyamide nylon have an ideal co-efficient of linear thermal expansion of about 0.00009 inches per degree centigrade.

The thickness of the support disk 20 is important. If it is too thick, the grinding disk 10 will not smoothly and continuously heat disintegrate at the same rate as the plastic resin grit containing layer is abraded away. If it is too thin, it will not have sufficient strength to support the grit containing layer in parallel grinding operations. It has been found that a thickness of a suitable plastics material at the outer peripheral edge of a disk should be between five and fifty thousandths of an inch.

The diameter of the grinding disk is also important. The desirable characteristics of this invention can most easily be incorporated into a disk having a diameter less than four inches. Above a diameter of four inches at the thickness noted above problems of incorporating sufficient strength into the composite disk without adding support ribs or strengthening fibres in the thermal plastic disk body become unmanageable. A grinding disk with support ribs for the thermal plastics disk body cannot be used in an edge grinding operation because the support ribs interfere with the smooth heat disintegration of the disk body 20. A disk body with glass fibre or like reinforcement cannot be trimmed by edge grinding because the fibres interfere with the smooth disintegration of the disk body under conditions of edge grinding. They adversely affect the deflection temperature.

It is possible to add small amounts of compatible fillers and strengthening chemicals into the nylon without destroying the ability of the disk to heat disintegrate smoothly under conditions of edge grinding but the additions must be within limits that do not affect adversely the co-efficient of linear thermal expansion. Too low a co-efficient of linear expansion does not allow the backing material to smoothly and continuously heat disintegrate on edge grinding. Too high a co-efficient of linear thermal expansion results in too rapid a heat disintegration on edge grinding operations. It has been found that the co-efficient of linear thermal expansion of the disk body 20 should be between 0.00005 to 0.0001 inch per inch per degree centigrade.

The coefficient of linear thermal expansion as determined by test D696-79 of the American Society for Testing and Materials measures thermal expansion excluding consideration of phase changes such as the melting or disintegration of the plastics material under conditions of edge grinding but it has been found that the limitation of the plastics material for satisfactory edge grinding can be defined by reference to linear thermal expansion as defined by these tests. The things that must be avoided such as fiber reinforcing and excessive fillers affect linear expansion and affect suitability for disintegration in edge grinding.

This A.S.T.M. method covers determination of the coefficient of linear thermal expansion for plastics by use of a vitreous silica dilatometer. At the test temperatures and under the stresses imposed, the test materials has a negligible creep or elastic strain rate or both, insofar as these properties would significantly affect the accuracy of the measurements. This A.S.T.M. test method is intended to provide a means of determining the coefficient of linear thermal expansion of plastics which are not distorted or indented by the thrust of the dilatometer on the specimen. The specimen is placed at the bottom of the outer dilatometer tube with the inner tube resting on it. The measuring device which is firmly attached to the outer tube is in contact with the top of the inner tube and indicates variations in the length of the specimen with changes in temperature. Temperature changes are brought about by immersing the outer tube in a liquid bath at the desired temperature. The test is standard and well known and detailed reference is not made to it.

The layer of thermosetting plastics resin 22 which contains the abrasive grit is cured and can conveniently be a plastic resin material of the type commonly referred to as a phenolic resin. This liquid reactive single stage phenol formaldehyde resin modified with fillers and other ingredients is commonly used for bonding coated abrasives. A satisfactory phenol formaldehyde resin of this type is commonly available from Reichold Chemical Company as their 29-368 type.

The curing temperature of the cured plastics resin that contains the grit is significant. The thermo plastics disk body 20 must retain its shape as the grit containing resin is cured in the manufacturing operation. If the curing temperature is too high, the heat applied to cure will be higher than the thin thermoplastics disk body 20 can stand without becoming unreasonably deformed in the curing operation. It will be recalled that there is a limit to the thickness of the disk body to achieve satisfactory edge grinding characteristics and a disk body in these thickness ranges requires the use of a grit retaining resin that will cure at a relatively low temperature. It has been found that the thermosetting resin that contains the grit should cure at a temperature of less than 125° C.

The use of the self-supporting grinding disk of the invention has been referred to previously in this specification. FIG. 5 shows the disk in a parallel grinding operation and FIG. 6 shows the disk in an edge grinding situation. The disk is particularly well suited to cut notches in iron as illustrated in FIG. 6. As the cutting continues, the diameter of the composite grinding disk is reduced as the abrasive grit and thermosetting resin are worn away at the same rate as the supporting thermo plastic disk body is smoothly and continuously heat disintegrated.

A feature of the disk is that it can be trimmed in diameter as required when the principal operation is parallel grinding. In parallel grinding, the marginal portion at the outer edge of the disk is usually worn first. Grit inwardly of the marginal edge portion is not worn away to the same extent. With this invention, one can operate a disk that has been worn in a parallel grinding situation in the edge grinding mode to reduce the diameter and present a better marginal portion for parallel grinding.

Figure 2:
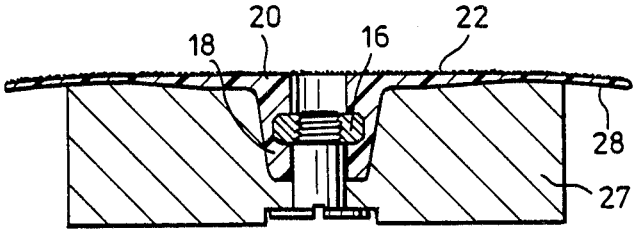
FIG. 2 is a view similar to FIG. 1 but showing the disk body mounted in a pressed wood support wherein its outer face is coated with a layer of thermosetting plastics resin which contains abrasive grit and cured in the disk manufacturing process described herein.
Figure 3:
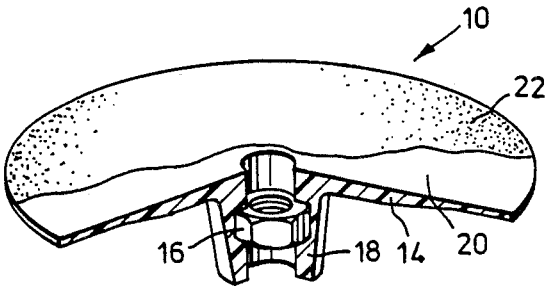
FIG. 3 illustration of a self-supporting grinding disk according to the invention, partly broken away to show construction.
Figure 3:
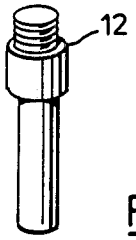

It will also be noted from sectional view of FIG. 2 that the marginal portion of the disk as manufactured slopes rearwardly of the grinding face at the marginal portions of the edge. This facilitates edge grinding for the life of the rearward slope. It will be apparent that one can edge grind with such a configuration with the grinding tool at a greater angle to the workpiece. This is an advantage that can be realized with a fresh disk. As the disk is worn down at the edge portion as in the case illustrated in the disk of FIGS. 5 and 6, the advantage of this construction disappears. However, it has been found of practical significance in use and is achieved in the curing operation as will be noted later.

The trimming and edge grinding features of this grinding disk are significant improvements over the prior art. With the prior art, the grinding disk is supported on a resilient back-up pad and attempts at edge grinding wear the detachable disk quickly and separately from the rubber back-up pad. The grinding disk soon becomes separated and torn and useless.

The added utility of being able to grind indefinitely at an angle of substantially ninety degrees to the face of the grinding disk without destroying the flexible disk of the grinding assembly is a very important advance in the art.

Following is an example of the manufacture of a self-supporting grinding disk according to the invention.

A disk body 20 having a diameter of about three inches, a central hub portion 18 and a flexible workpiece-contour-following portion outwardly of the hub was moulded in a 275 ton injection moulding machine. The workpiece-contour-following portion tapered somewhat from the hub portion to the outer edge and had an outer edge thickness of about 32 thousandths of inches.

The disk body 20 was secured by means of a metal screw and nut to a pressed wood form 27 as illustrated in FIG. 2.

Figure 4:
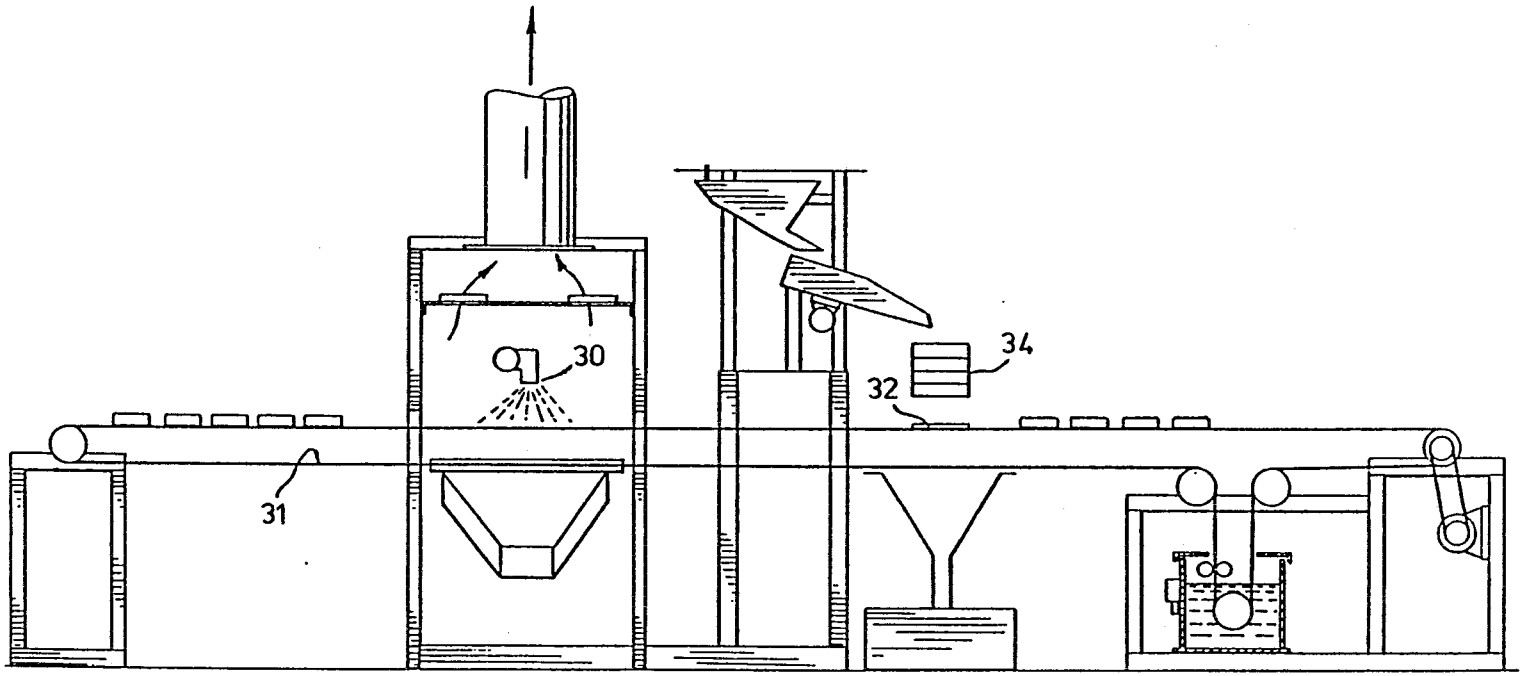
FIG. 4 is a schematic illustration of the manner of manufacturing a self-supporting grinding disk according to this invention.

The mounted assembly was processed in a production line similar to the one illustrated in FIG. 4. The assembly was conveyed on a conveyor belt 31 under the spray nozzle 30 to receive a coating of phenolic resin calcium carbonate mixture to a density of 0.0201 grams per square centimetre.

As it proceeded along the conveyor line, it received a coating of electro-statically charged abrasive grain as at 32. The grain is according to standard coating practice charged through charging screens 34 in order to separate the particles one from the other as they are applied to the surface.

The abrasive grain used was 60 grit alumina zirconia manufactured by the Norton Company and sold under the trade mark NORZON ™. The grain was applied to achieve a coating density of 0.0500 grams per square centimeter.

The assembly was then dried in an oven for one hour at 95° C.

A sizing coat of thermosetting resin was then applied by repassing the coated disk bodies under the resin applying head 30. The sizing coating was a mixture of resin Reichold 29368 and calcium carbonate and with the viscosity adjusted to 375 centipois at 20° C. A coating weight of 0.0241 grams per square centimeter was applied.

The coated assembly was dried for one hour at 95° C. and cured for three hours at 105° C. Following the cure, the assembly was subjected to high relative humidity air for several hours.

During the curing operation the thermoplastics body becomes heated and soft. It tends to droop at the marginal portions beyond where it is supported in the pressed wood form 27 and the cured thermosetting material shrinks and cures the underlying soft thermoplastics material with it. This is how the mushroom-shaped edge portion is achieved. As noted above the curing temperature of the polyamide resin is important because if it required a curing temperature of above about 125° C. the thermoplastics disk would become overheated and over soft in the curing operation and uncontrollable shrinkage and objectionable deformation would result.

The abrasive disc assembly was tested by attaching it to a rotating shaft of an air grinding tool and rotated at 23,000 RPM's.

The outer periphery of the disc was mounted at a right angle to a section of ¼ inch angle iron. The rotating disk then was held against the angle iron to grind a series of notches. Notches to a depth of ½ inch were rapidly cut into the iron. As the grinding continued a slight reduction in the diameter of the disc was noted.

In comparison, the same test was tried using standard coated abrasive grinding disks mounted on back-up pads. After exhaustive testing, it was found the disk of the invention to be much superior. Edge grinding with the existing present day disks caused the disks to fray and break up and in some cases, rupture of the support back-up pad was noted.

A further test example of a disk according to this invention comprised an injection moulded back-up pad of similar nylon material and approximately 4 inches in diameter in a similar construction to the drawing shown as FIG. 2. In this example a resin mix was applied at a rate of 0.0201 grams per square centimeter, followed by an electrostatic coating of abrasive grit of 0.0562 grams per square centimeter of 60 grit aluminum oxide graded for normal coated abrasive applications. The coated article was dried for one hour at 95° centigrade and coated for a second time with a mixture of Reichold (Trade Mark) resin 29368 and calcium carbonate adjusted to a viscosity of 375 centipois as a size coat of 0.0241 grams of resin mix per square centimeter. The article was dried for one hour at 105° centigrade. Following the cure the abrasive disk was held immersed in container into which high humidity air was pumped.

The finished product was tested by grinding with a Florida (Trade Mark) Pneumatic air tool at 20,000 RPM. The material ground was titanium cap as used in the construction of helicopter blades.

It was found that the disk would remove titanium on parallel grinding at a rate of 0.33 grams per minute.

Testing a conventional resin aluminum oxide cloth of the same diameter and grit size and supported by a rubber reinforced back-up pad, it was found the grinding rate dropped to 0.16 grams per minute.

This drop in grinding efficiency was probably due to heat build up in the present day product. The present disk ran much cooler by dissipating the heat through the thermoplastic backing.

Edge grinding to test stock removal was tested. It was found the present disk removed titanium at a rate of 0.56 grams per minute. While conventional disks removed only 0.27 grams per minute.

The conventional product mounted on a rubber back-up pad lost grit on the outer edge accounting for the drop off in stock removal.

Other modifications in formulations within the scope defined will be apparent to those skilled in the art. For example, fillers can be used in the body material but only in small amounts for the reason explained, so as not to get beyond the limits defined above.

What I claim as my invention is:

1. A self-supporting grinding disk for mounting on the shaft of a power tool for rotation, the disk having an abrasive grinding face for parallel grinding and a peripheral edge for edge grinding comprising:

a round disk body of thermoplastics material, said disk body having a central hub portion for securing the disk to a shaft and a flexible workpiece-contour-following portion outwardly of the hub portion;

a layer of thermosetting plastics resin which contains abrasive grit coated directly on the disk body to comprise the grinding face of said grinding disk, the plastics resin being curable at a temperature of less than 125° C. and cured, the thermosetting plastics resin being compatible with the thermoplastics material of the disk body and being bonded and adhesively fused thereto;

the thickness of the disk body outwardly of the hub being between five one thousandths and fifty one thousandths of an inch;

the diameter of the disk body being no more than four inches;

the disk body having a coefficient of linear thermal expansion between 0.00005 and 0.0001 inch per inch per degree centigrade as tested by the A.S.T.M. testing standard D 696-79;

the disk body being composed substantially of a polyamide thermoplastic material and having a deflection temperature under flexural load of 264 psi of between 125° F. and 350° F. according to the A.S.T.M. testing standard D648-82;

the disk body having a melting point to withstand the heat of grinding friction in parallel grinding operations but to be smoothly and continuously heat disintegratable at the same rate as the layer of thermosetting plastics resin which contains the abrasive when the periphery of the grinding disk is used for edge grinding a work piece whereby to present fresh grinding abrasive to the work piece as the diameter of the disk decreases.

2. A self-supporting grinding disk as claimed in claim 1 in which the marginal edge portion thereof curves downwardly of the principal plane of the grinding face of the grinding disk.

3. A self-supporting grinding disk as claimed in claim 1 in which said disk body is moulded substantially from a polyamide thermoplastics resin.

4. A self-supporting disk as claimed in claim 3 in which said thermosetting plastics resin is a phenolic resin.

5. A self-supporting disk as claimed in claim 1 in which said thermosetting plastics resin is a phenolic resin.

6. A self-supporting grinding disk as claimed in claim 3 in which the marginal edge portion thereof curves downwardly of the principal plane of the grinding face of the grinding disk.

7. A self-supporting grinding disk as claimed in claim 4 in which the marginal edge portion thereof curves downwardly of the principal plane of the grinding face of the grinding disk.

8. A self-supporting grinding disk as claimed in claim 5 in which the marginal edge portion thereof curves downwardly of the principal plane of the grinding face of the grinding disk.

9. A self-supporting grinding disk as claimed in claim 1 having a disk body with a diameter of about 3 inches.

* * * * *